United States Patent [19]

Whiddon et al.

[11] Patent Number: 4,657,066

[45] Date of Patent: Apr. 14, 1987

[54] METHOD OF CONTINUOUS CASTING SLABS TO PRODUCE GOOD SURFACE QUALITY HOT-ROLLED BAND

[75] Inventors: Clifford R. Whiddon, Lower Burrell; Daniel R. Flaherty, Pittsburgh; Lawrence E. Turowski, Natrona Heights, all of Pa.

[73] Assignee: Allegheny Ludlum Corporation, Pittsburgh, Pa.

[21] Appl. No.: 750,570

[22] Filed: Jun. 28, 1985

[51] Int. Cl.[4] ..... B22D 11/00

[52] U.S. Cl. ..... 164/476; 164/459; 420/43; 420/122

[58] Field of Search ..... 164/459, 476, 477; 75/128 R, 128 W; 148/38; 420/43, 122

[56] References Cited

U.S. PATENT DOCUMENTS 4,007,038 2/1977 Deverell ..... 75/122

4,408,652 10/1983 Ouchi et al. ..... 164/459

*Primary Examiner*—Kuang Y. Lin

*Attorney, Agent, or Firm*—Patrick J. Viccaro

[57] ABSTRACT

A method is provided for producing substantially austenitic stainless steel strip, particularly chromium-nickel grades, having ultra low sulfur levels up to 0.002% by conventionally continuously casting the slab and thereafter hot rolling the slab to hot-rolled band by improving the ability to achieve hot-rolled band having good surface quality as characterized by reduced metallurgical slivers.

17 Claims, No Drawings

METHOD OF CONTINUOUS CASTING SLABS TO PRODUCE GOOD SURFACE QUALITY HOT-ROLLED BAND

BACKGROUND OF THE INVENTION

This invention relates to a method of continuously casting stainless steel slabs which when hot rolled to an intermediate gauge have improved surface quality. More particularly, this invention relates to a method of continuously casting austenitic stainless steel with ultra low sulfur levels to improve the surface quality of hot-rolled band.

In the production of steel slabs, it is a customary practice to produce a melt of the desired steel composition by any of conventional means, including an electric furnace, a top-blown oxygen converter, or an argon-oxygen decarburization (AOD) vessel. The steel, which may be a stainless steel, in molten form is then transferred from the furnace to a transport ladle from which it is teemed into a flow-through continuous casting mold and apparatus. The steel is cooled within the continuous casting mold to form a slab having a solidified skin and a molten metal interior. This partially solidified casting is then passed through a series of support rolls and water-cooling sprays which serve to further solidify the casting so that it is completely solidified before it exits from the support rolls. The casting is then cut to desired lengths for further processing.

Generally, further processing includes hot rolling and cold rolling to final gauge. Typically, however, prior to the hot-rolling operation, the slab surface is conditioned by a surface removal operation, such as surface grinding, to remove oxides, scale, and surface defects which may be in the form of nonmetallic inclusions, as well as oscillation marks resulting from the continuous caster. In many cases, a failure to condition the slab prior to hot rolling will result in poor surface quality of the hot-rolled band and the cold-rolled final gauge product.

Whether or not the slab is conditioned, it may then be reheated or annealed in a furnace and hot rolled to an intermediate or final gauge. Conventionally, the hot-rolled band may be annealed and descaled, such as by shot blasting and pickling, and inspected for surface quality. If the hot-rolled band has good surface quality, the band may then be acceptable for its intended applications or may be further processed by cold rolling with or without intermediate anneals to a cold-rolled final gauge. If the hot-rolled band quality is unacceptable, the band may be ground or otherwise surface treated to improve the surface quality, or may be scrapped. The required slab surface conditioning operation prior to hot rolling and the conditioning of the hot-rolled band are labor-intensive operations and add considerably to the overall cost of production and lessen productivity by increasing yield losses.

Attempts have been made by others to improve the hot workability of stainless steels. The adverse effects of sulfur on hot workability are generally well known. For example, U.S. Pat. No. 4,007,038, assigned to the common Assignee of the present application, discloses providing good hot workability characteristics in a high molybdenum austenitic stainless steel by maintaining sulfur of less than 0.006%, together with additions of critical amounts of both calcium and cerium. The hot workability is characterized by reduced edge checks in the hot and cold finish strips.

It is desirable to improve the hot-rolled band surface quality of coils rolled from slabs which are continuously cast. More particularly, it is desirable to improve the hot-rolled band surface quality from slabs whether or not they are conditioned prior to the hot-rolling operation. It is desirable that any method for improving the hot-rolled band surface quality permit bypassing of the conditioning operation to reduce the overall cost of the final product. The method should result in continuously-cast slabs which result in hot-rolled band of improved surface quality whether or not the slabs are surface conditioned. It is further desirable to improve the hot-rolled band surface quality of the chromium-nickel and chromium-nickel-molybdenum grades of stainless steels which at the hot-rolled band stage appear to be more prone to metallurgical slivers and/or defects due to oscillation marks from the slab.

SUMMARY OF THE INVENTION

In accordance with the present invention, a method is provided for producing a substantially austenitic stainless steel strip comprising continuously casting a slab of the steel having a composition including about 15% or more chromium, about 5% or more nickel, and up to b 0.002% max. sulfur, and the balance being iron and normal steelmaking additions and residuals. The method further includes hot rolling the slab to a hot-rolled band which has a good surface quality characterized by reduced metallurgical slivers and/or defects due to oscillation marks from the slab.

DETAILED DESCRIPTION OF THE PREFERRED EMBODIMENTS

Broadly, in the practice of the invention, the method thereof for producing stainless steel slabs by continuous casting operation in which the resulting hot-rolled bands are characterized by an improved surface which is achieved by controlling the sulfur to ultra low levels in the molten stainless steel composition. More specifically, the sulfur is maintained at a critical maximum, which maximum may vary depending somewhat upon the composition of the stainless steel. Broadly, the sulfur maximum in accordance with the invention is 0.002% and, preferably, 0.001% maximum. All composition percentages recited herein are by weight.

It has been found in arriving at the present invention that the chromium-nickel grades of stainless steels, such as the AISI 300 Series, are more likely to have poor surface quality in the hot-rolled band than other stainless steels such as in the AISI 200 Series, for example. It has also been found that the more austenite in the stainless steel and/or the more highly alloyed the steel, the more likely it is for the hot-rolled band to exhibit poor surface quality in the form of metallurgical slivers. Fully austenitic steels are more prone to metallurgical slivers in the hot-rolled band than stainless steels that are only substantially austenitic or ferritic.

For purposes herein, the criteria for determining the hot-rolled band surface quality is determined by inspection after descaling the hot-rolled band. The inspection includes both visual and feeling or touching of the surface. A hot-rolled band exhibiting good surface quality will have good surface integrity and be smooth and unbroken in appearance and to the touch. Poor surface quality will exhibit metallurgical slivers in the surface, forming a rough and broken and nonuniform surface in appearance and to the touch. The hot-rolled band may or may not be annealed prior to further processing, such as descaling and cold rolling. Such an annealing step does not appear to contribute to the invention.

Earlier work in continuous casting of the AISI 200 Series grades indicated that maintaining sulfur levels of about 0.01% maximum, and preferably 0.007% maximum, and most preferred 0.005% maximum, resulted in improved surface quality of the hot-rolled band if the slabs were not surface conditioned prior to hot rolling. The commercial specification for the chromium-manganese-nickel alloys of the 200 Series is about 0.030% maximum sulfur. Such grades, however, are more easily produced with acceptable hot-rolled band surface quality than the AISI 300 Series.

Though there is no intention to be bound by a particular theory, it appears that the maximum tolerable sulfur level is a function of the solidification mechanism for the grade which effects the tolerance for sulfur in that grade and the alloy content and how it affects the hot ductility of the slabs. Furthermore, the more austenitic the grade and/or the more highly alloyed the grade, the less tolerance for sulfur and the more likely that the hot-rolled band will exhibit surface quality problems. Generally the best results are obtained at the lowest possible sulfur levels. Preferably it has been found that the amount of sulfur should be controlled to amounts which are inversely related to the amount of austenitic structure in the slab and to the more highly alloyed slab compositions. In other words, within the range of sulfur up to 0.002% maximum, relatively lower sulfur levels should be achieved for grades having relatively more austenitic structure or which are relatively more highly alloyed in order to improve the ability to achieve hot-rolled band having good surface quality.

Whether slabs are surface conditioned or not, it appears that metallurgical slivers result from a reduction in the hot ductility and the resulting hot tearing of the slab surface due to tensile stresses produced by hot rolling. Tearing results when the tensile elongation exceeds the hot ductility. These metallurgical slivers are not known to be the result of a preexisting defect in the slab surface. It appears that the maximum tolerable stresses are lower at higher sulfur levels. If the slabs are not conditioned, there is an additional problem that oscillation marks resulting from the continuous caster can open up, creating a distinctive pattern due to hot tearing during the hot-rolling operation. Though the mechanism is not clearly understood, it clearly appears that lower sulfur appears to have a favorable effect on improving the surface quality of the hot-rolled band made from continuously cast slabs.

The method of the present invention is particularly suited for stainless steel compositions including about 15% or more chromium and about 5% or more nickel as major constituents. More particularly, the steel slab composition having 16 to 26% chromium, and more preferably 16 to 26% chromium, benefits from the invention with improved surface quality of the hot-rolled band. Furthermore, such steel slab compositions having 6 to 22% nickel, and more preferably 6 to 17% nickel, benefit by the method of continuously casting in accordance with the present claimed invention. The steel composition may further include up to 5% molybdenum, as well as additions of other elements such as titanium and columbium which are useful for improving specific properties of stainless steel such as pitting, crevice, or intergranular corrosion resistance, or for stabilization. The composition may contain normal steelmaking residuals and the balance iron.

More particularly, the steel slab composition may have 16–26% Cr and 6–22% nickel. Specifically, the composition may have about 16–20% chromium, and 6–17% nickel, and up to 5% molybdenum, or about 16–18% chromium, about 10–14% nickel, and up to 3% molybdenum. Other alloys which should benefit from the invention may contain about 16–18% chromium and about 6–8% nickel, or about 18–20% chromium and about 8–12% nickel as major constituents.

In order to more completely understand the present invention, the following examples are presented.

EXAMPLE I

A mill experiment was conducted on typical AISI 316/316L Grade alloys by melting, continuously casting, and hot rolling the steel to sheet size in coil form. The heats were melted in a commercial production-size argon-oxygen decarburization (AOD) vessel, having a composition falling within the following typical analysis of AISI 316/316L:

| C | Mn | Si | P | Cr | Ni | Mo | Fe |
|---|---|---|---|---|---|---|---|
| 0.08 max/ 0.03 max. | 2 max. | 1 max. | .045 max. | 16–18 | 10–14 | 2–3 | Bal |

The elements of the composition were alloyed in a molten state and prior to tapping the vessel, various desulfurization mixes were used to arrive at various sulfur levels as set forth in Table I. Each heat was then continuously cast into a slab of about 8 inches (20 cm) thick by 51 inches (127 cm) wide. The slabs were then conventionally surface conditioned by grinding using abrasive wheels. The ground slabs were then reheated to in excess of 2000° F. (1093° C.) in a furnace and hot rolled directly to hot-rolled band intermediate gauge in coil form. The hot-rolling operation included hot reducing the slab to less than 1-inch (2.5 cm) thickness and immediately hot rolling to the hot-rolled band gauge (HRB). The hot-rolled band was then annealed and descaled by shot blasting and pickling and thereafter inspected for surface quality. The hot-rolled band gauge was on the order of 0.20 inch (0.5 cm). The results of the inspection are shown in Table I.

TABLE I

| Heat | Sulfur (wt. %) | # HRB Coils | # Coils OK | % Coils OK |
|---|---|---|---|---|
| A | .001 | 11 | 10 | — |
| B | .002 | 11 | 5 | — |
| C | .001 | 7 | 7 | — |
| D | .002 | 6 | 4 | — |
| E | .001 | 10 | 9 | — |
| F | .003 | 8 | 0 | — |
| G | .019 | 4 | 3 | — |
| H | .003 | 10 | 6 | — |
| I | .002 | 9 | 6 | — |
| J | .002 | 10 | 10 | — |
| Totals | .001 | 28 | 26 | 92.8 |
| | .002 | 36 | 25 | 69.4 |
| | ≧.003 | 22 | 9 | 40.9 |

As shown by the results of Table I, the level of sulfur in conventional AISI 316/316L stainless steel hot rolled from continuously cast slabs which were surface conditioned by grinding prior to hot rolling has a direct bearing on the surface quality of the hot-rolled band. Typically, AISI 316/316L Grade may contain up to 0.030% sulfur. From Table I, the heats having sulfur levels of about 0.003% or more had a considerable number of hot-rolled coils being rejected even though the slabs were surface conditioned prior to hot rolling. More specifically, only about 40.9% of the hot-rolled band coils had surface quality which was found acceptable. Those heats having sulfur levels of about 0.002% had about 69.4% of the hot-rolled band coils having acceptable surface quality. For even lower sulfur levels of about 0.001%, the number of coils having good surface quality increased dramatically up to about 92.8%. The data clearly show that lowering sulfur to ultra low levels on the order of about 0.002% or less has a dramatic improvement on being able to produce hot-rolled bands having good surface quality even when the slabs have been surface conditioned prior to the hot rolling operation. Prior to the method of the present invention, the rejection rate of the T316/316L hot-rolled band due to surface quality was typically on the order of 50%, in other words, only about 50% of the coils were found to have acceptable surface quality. Such rejected coils then would require surface conditioning by grinding, or the like to improve the surface quality, however, resulting in increased production costs and larger yield losses.

EXAMPLE II

Another mill experiment was conducted in order to determine whether the hot-rolled band surface quality rejection rate is improved whether or not the slabs are surface conditioned prior to the hot rolling operation. Heats of Type 304 stainless steel having sulfur levels of about 0.002% or less were prepared having a composition falling within the following typical AISI 304 composition:

| C | Mn | Si | P | Cr | Ni | Fe |
|---|---|---|---|---|---|---|
| .08 max. | 2 max. | 1 max. | .045 max. | 18–20 | 8–10.5 | Bal. |

The heats were prepared in a manner similar to that of Example I, however, the slabs continuously cast from Heats A through D were split such that some of the slabs were surface conditioned by grinding prior to the hot rolling operation and other slabs were not surface conditioned prior to the hot rolling operation. The results of the mill experiment are set forth in Table II.

TABLE II

| Heat | Sulfur (wt. %) | # HRB Coils (from ground slabs) | # HRB Coils (no slab grinding) | # Coils OK | % Coils OK |
|---|---|---|---|---|---|
| A1 | .001 | 5 | — | 5 | — |
| B2 | .001 | 5 | — | 4 | — |
| C1 | .001 | 7 | — | 6 | — |
| D1 | .002 | 10 | — | 9 | — |
| A2 | .001 | — | 5 | 5 | — |
| B2 | .001 | — | 5 | 2 | — |
| C2 | .001 | — | 6 | 5 | — |
| D2 | .002 | — | 10 | 6 | — |
| Totals | | | | | |
| for Ground Slabs | | 27 | — | 24 | 92.3 |
| for No Grind Slabs | | — | 26 | 18 | 75 |

The data of Table II show that ultra low sulfur levels for Type 304 stainless steel provide a high percentage of hot-rolled band coils having acceptable surface quality whether or not the slabs are surface conditioned by grinding prior to the hot rolling operation. Though the ultra low sulfur levels do not result in 100% acceptable surface quality, there is significant improvement of the surface quality of the hot-rolled band coils from both the ground and unground slabs. There are other problems, such as slab grind pattern, laps, scale pattern, and mechanical damage that may result in coil rejections due to surface quality which are not related to the sulfur content. Even in the no-grind slab, about 75% of the hot-rolled band coils had acceptable surface quality. Prior to the method of the present invention, very few continuously cast slabs of Type 304 stainless steel were not surface conditioned prior to the hot rolling operation due to the great tendency for those hot-rolled bands to exhibit the metallurgical slivers. Typically, such unground slabs prior to the present invention may exhibit on the order of 80% rejection.

Consistent with the objectives of the present invention, a larger percentage of hot-rolled bands made from continuously cast slabs can exhibit good surface quality as characterized by the reduced metallurgical slivers. Furthermore, it is apparent that in view of the teachings of the present invention, those skilled in the art may determine which grades may be continuously cast into slab form to bypass the labor-intensive and costly surface conditioning operation and still produce a large percentage of hot-rolled bands having good surface quality. Though the method of the present invention may be useful for any stainless steel composition, it is particularly suited for chromium-nickel and chromium-nickel-molybdenum austenitic grades.

Although preferred and alternative embodiments have been described, it will be apparent to one skilled in the art that changes can be made therein without departing from the scope of the invention.

What is claimed is:

1. A method of producing a substantially austenitic stainless steel strip comprising:

continuously casting a slab of said steel having a composition consisting essentially of, by weight, about 15% or more chromium, about 5% or more nickel, up to 5% molybdenum, up to 0.002% maximum sulfur, the balance iron and normal steelmaking additions and residuals; and hot rolling the slab to a hot-rolled band gauge;

the hot-rolled band, which when descaled, has a good surface quality characterized by reduced metallurgical slivers.

2. The method as set forth in claim 1, wherein the steel slab has a sulfur content of 0.001% maximum.

3. The method as set forth in claim 1, wherein the steel slab composition includes 16–26% Cr and 6–22% nickel.

4. The method as set forth in claim 1, wherein the steel slab composition includes about 16–20% chromium, about 6–17% nickel, and up to 5% molybdenum.

5. The method as set forth in claim 1, wherein the steel slab composition includes about 16–18% chromium, about 10–14% nickel, and up to 3% molybdenum.

6. The method as set forth in claim 1, wherein the steel slab composition includes about 16–18% chromium and about 6–8% nickel.

7. The method as set forth in claim 1, wherein the steel slab composition includes about 18–20% chromium and about 8–12% nickel.

8. The method as set forth in claim 1, including surface conditioning the cast slabs before hot rolling.

9. The method as set forth in claim 1, wherein the slab is reduced by hot rolling in the absence of slab surface conditioning.

10. The method as set forth in claim 1, including further processing by descaling the hot-rolled band and cold rolling to final gauge.

11. The method as set forth in claim 1, including further processing by annealing the hot-rolled band.

12. The method as set forth in claim 1, including further processing by annealing and descaling the hot-rolled band and cold rolling to final gauge.

13. The method as set forth in claim 1, wherein controlling sulfur to amounts which are inversely related to the amount of austenitic structure in the slab.

14. A method of producing a substantially austenitic stainless steel strip comprising:

continuously casting a slab of said steel having a composition consisting essentially of, by weight, about 16–20% chromium, about 6–17% nickel, up to 5% molybdenum, up to 0.002% maximum sulfur, the balance iron and normal steelmaking additions and residuals;

hot rolling the slab to a hot-rolled band gauge;

annealing the hot-rolled band; and descaling the hot-rolled band, said descaled hot-rolled band exhibiting good surface quality characterized by reduced metallurgical slivers.

15. The method as set forth in claim 14, including surface conditioning the cast slabs before hot rolling.

16. The method as set forth in claim 14, wherein the slab is reduced by hot rolling in the absence of slab surface conditioning.

17. The method as set forth in claim 14, wherein the steel slab has a sulfur content of 0.001% maximum.

* * * * *